United States Patent [19]

Antonissen

[11] Patent Number: 4,532,840

[45] Date of Patent: Aug. 6, 1985

[54] SLICING MACHINE HAVING MEANS TO DETERMINE IF SUFFICIENT PRODUCT REMAINS TO CUT A WHOLE SLICE

[75] Inventor: Peter Antonissen, Norfolk, England

[73] Assignee: Thurne Engineering Company Limited, Norfolk, England

[21] Appl. No.: 614,430

[22] Filed: May 29, 1984

[30] Foreign Application Priority Data

May 27, 1983 [GB] United Kingdom ..... 8314766

[51] Int. Cl.[3] ..... B26D 5/20

[52] U.S. Cl. ..... 83/71; 83/81; 83/88; 83/278; 83/364; 83/367

[58] Field of Search ..... 83/69, 71, 73, 77, 80, 83/81, 82, 278, 399, 400, 364, 367

[56] References Cited

U.S. PATENT DOCUMENTS

| | | | |
|---|---|---|---|
| 4,309,927 | 1/1982 | Dennis | 83/278 X |
| 4,344,341 | 8/1982 | Lotz | 83/81 X |
| 4,457,194 | 7/1984 | Mally | 83/437 X |

*Primary Examiner*—James M. Meister

*Attorney, Agent, or Firm*—Sughrue, Mion, Zinn, Macpeak and Seas

[57] ABSTRACT

A slicing machine including a rotating blade 1 and a feeding head 8 to feed a block of food product towards the blade includes a position detector 38 to detect when the feeding head 8 is a predetermined distance away from the end of its stroke, an encoder 32 associated with the drive 12 of the feeding head 8 to monitor movement of the feeding head 8 over the predetermined distance from the position detector 38 to the end of its stroke, and a cam and proximity switch 34,35 to monitor the movement of the blade 1 of the slicer. The machine also includes a computer 18 to monitor the position of the feeding head 8 as it moves towards the end of its stroke to establish when there is insufficient of the stroke of the feeding head 8 remaining to allow another whole slice of product to be cut before the feeding head 8 reaches the end of its stroke and to return the feeding head 8 to its starting position after completing the slicing of the last whole slice.

9 Claims, 2 Drawing Figures

SLICING MACHINE HAVING MEANS TO DETERMINE IF SUFFICIENT PRODUCT REMAINS TO CUT A WHOLE SLICE

BACKGROUND OF THE INVENTION

This invention relates to slicing machines that are principally used for slicing food products, particularly for slicing cheese, meat and pressed or moulded meat products.

Such a slicing machine comprises a rotating blade which either has a spiral cutting edge or has a circular cutting edge and is mounted for planetary motion, and means to feed the product towards the blade so that upon each revolution or each gyration of the blade, a slice is cut from the face of the product. The means to feed the product may be a continuous conveyor but usually the slicer includes a fixed platform on which the product is placed, and a feeding head which engages the rear face of the product and which urges it product towards the blade. The feeding head may be moved by a hydraulic ram or by a leadscrew driven by a stepping or variable speed electric motor.

The product may be moved forwards at a constant speed so that upon each revolution or each gyration of the blade a slice is cut from its face. Typically the feeding head is moved continuously to cut relatively thin slices of, for example ham or sausage. Alternatively, the piece of meat or meat product is moved forward by the feeding head stepwise each time the cutting edge of the blade is away from the product. This is typically used where thicker slices are required, for example when slicing corned beef.

Such slicing machines usually include a physical abutment to prevent the feeding head being moved forwards beyond a predetermined point and so prevent the feeding head from being brought into contact with the cutting edge of the blade. In addition to this they also include an end stop detector which detects the presence of the feeding head upstream from the physical abutment and emits a signal to stop the further forwards movement of the feeding head and return it to its starting position remote from the cutting blade. The end stop detector and the physical abutment are normally placed close together in the feeding direction so that as much of the block of product is cut as possible thereby to reduce waste. Typically the physical abutment and the end stop detector are a distance corresponding to only one, or at most two thin slices apart so that the maximum number of slices are cut from each block of product. However, when the slicing machine is cutting thick slices from a block of product it is possible for a further stepwise feed of the feeding head to be initiated when the feeding head is still upstream from the end stop detector but this further feeding step results in the feeding head hitting the physical abutment at high speed which can result in damage to the slicer. Whilst the presence of the feeding head is detected by the end stop detector the movement of the feeding head overruns and hits the physical abutment before the movement of the feeding head is disabled and before the feeding head is returned to its start position remote from the blade.

When the feeding head passes the end stop detector the forwards movement of the feeding head is stopped and the head is returned to its starting position, the slicing machine is usually part of the way through cutting a slice from the front face of the block of product. In this case the slice that is being sliced is destroyed as the remaining portion of the block of meat or meat product is moved away from the blade.

Usually the slicing machine, has a jump conveyor associated with it, the jump conveyor is arranged to produce groups of slices. After a predetermined number of slices have been cut and have fallen onto the jump conveyor its speed is increased for a short period of time. This provides a gap between the last slice of a preceding group and the first slice of a following group. This change in speed of the jump conveyor downstream of the blade is usually instigated and reset by the signal from the end stop detector so that, when the feeding head reaches the end of its travel a jump sequence of the jump conveyor is initiated. However, when this occurs at a time at which the last slice of a particular group has not been cut the leading slice in the part group of slices so formed is located at a different position on the jump conveyor from that normally occupied by a complete group of slices and this leads to the part group often being incorrectly discharged from the jump conveyor and results in further dislocation and possible damage to the slices of product.

SUMMARY OF THE INVENTION

According to this invention a slicing machine includes a position detector to detect when the feeding head is a predetermined distance away from the end of its stroke, an encoder associated with the drive of the feeding head to monitor movement of the feeding head over the predetermined distance from the position detector to the end of its stroke, means to monitor the movement of the blade of the slicer, and means to monitor the position of the feeding head as it moves towards the end of its stroke to establish when there is insufficient of the stroke of the feeding head remaining to allow another whole slice of product to be cut before the feeding head reaches the end of its stroke and to return the feeding head to its starting position after completing the slicing of the last whole slice.

The feeding head may include a vacuum pad which engages the rear face of the block of meat or meat product but preferably it comprises a pair of gripping jaws mounted on a movable carriage positively to grip and hold the rear end of the piece of meat or meat product. Preferably the slicing machine also includes an end stop detector located immediately before a physical abutment to prevent further movement of the feeding head and arranged to stop the forward movement of the feeding head and return it to its starting position. In this case, the end stop detector acts as a failsafe device to prevent damage to the slicing machine in the event of any failure of the means monitoring the position of the feeding head.

Preferably the slicing machine is associated with a jump conveyor and, in this case, preferably the means to monitor the position of the feeding head as it moves forwards towards the end of its stroke also controls the movement of the jump conveyor associated with the slicing machine so that the jump conveyor continues to move as if slices are still being cut from the face of the piece of meat or meat product, even after the feeding head has returned to its starting position, until it has carried out the movements corresponding to the completion of a normal group. In this way, the leading slice of even a partly complete group is always in the correct position at the initiation of the jump sequence to ensure that even only partly complete groups are still discharged from the jump conveyor without disturbance.

Preferably the means monitors the movement of the feeding head for each slice during the movement of the feeding head over the predetermined distance from the position detector to the end of its stroke and so establishes the movement required to complete a whole slice. If the feeding head is moved continuously then the output from the encoder on the drive of the feeding head is compared with the output from the means to monitor the movement of the blade of the slicer to establish the movement of the feeding head between each rotation or gyration of the blade. As an alternative to these, where the slicing machine includes means to preset the required thickness of each slice the means may receive a signal from the means to preset the slice thickness and compare this signal with the movement remaining of the feeding head before it reaches the end of its stroke.

Preferably the slicing machine includes a computer which is programmed to monitor the instantaneous position of the feeding head as it moves towards the end of its stroke and to establish when there is insufficient of the stroke of the feeding head remaining to allow another whole slice of meat or meat product to be cut. In this case the computer may calculate the average thickness of the slice from the movement of the feeding head and the movement of the blade of the slicer. The computer may also be used to control the thickness of the slices that are cut from the block of meat or meat product and in this case it uses its calculated required thickness as the indication of the thickness of the next slice that is required to be cut at any instant and compares this with the stroke of the feeding head remaining.

Alternatively the slicing machine may include a first counter which is set to a value corresponding to the separation between the position detector and the end of the travel of the feeding head, the counter being decremented by the output from the encoder, a second counter which is incremented by the output of the encoder, a divider to divide the output of the second counter by the number of rotations or gyrations of the blade as determined by the means to monitor the movement of the blade, the output of the divider thus producing an indication of the average slice thickness, means to compare the count contained in the first counter with the output of the divider, and means to return the feeding head when the total in the first counter is less than the output of the divider.

Typically the position detector is located 100 mm upstream from the physical abutment at the end of the stroke of the feeding head and the encoder produces as its output a series of pulses corresponding to the movement of the feeding head. Typically the encoder produce 170 pulses per mm of travel of the feeding head.

Thus, firstly the slicing machine in accordance with this invention does not allow further movement of the feeding head unless there is sufficient travel remaining to allow movement corresponding to a complete slice, so that, when the feeding head is being moved in a stepwise mode the next step is not initiated unless there is sufficient of the stroke of the feeding head remaining for the next step to be completed. Equally, when the feeding head is being moved in the continuous mode, the continuous feed is stopped during or upon completion of a slice if there is not sufficient stroke of the feeding head remaining to allow the next slice to be completed. Secondly, since the means takes into account not only the position of the feeding head but also the position of the blade, it ensures that the feeding head is returned to its starting position after completion of the cutting one whole slice and before the start of the cutting of the next slice thus ensuring that no slices are damaged by the feeding head being returned to its starting position whilst a slice is being cut.

BRIEF DESCRIPTION OF THE DRAWINGS

A particular example of a slicing machine for slicing meat and meat products in accordance with this invention will now be described with reference to the accompanying drawings; in which.

DESCRIPTION OF PREFERRED EXAMPLE

Figure 1:
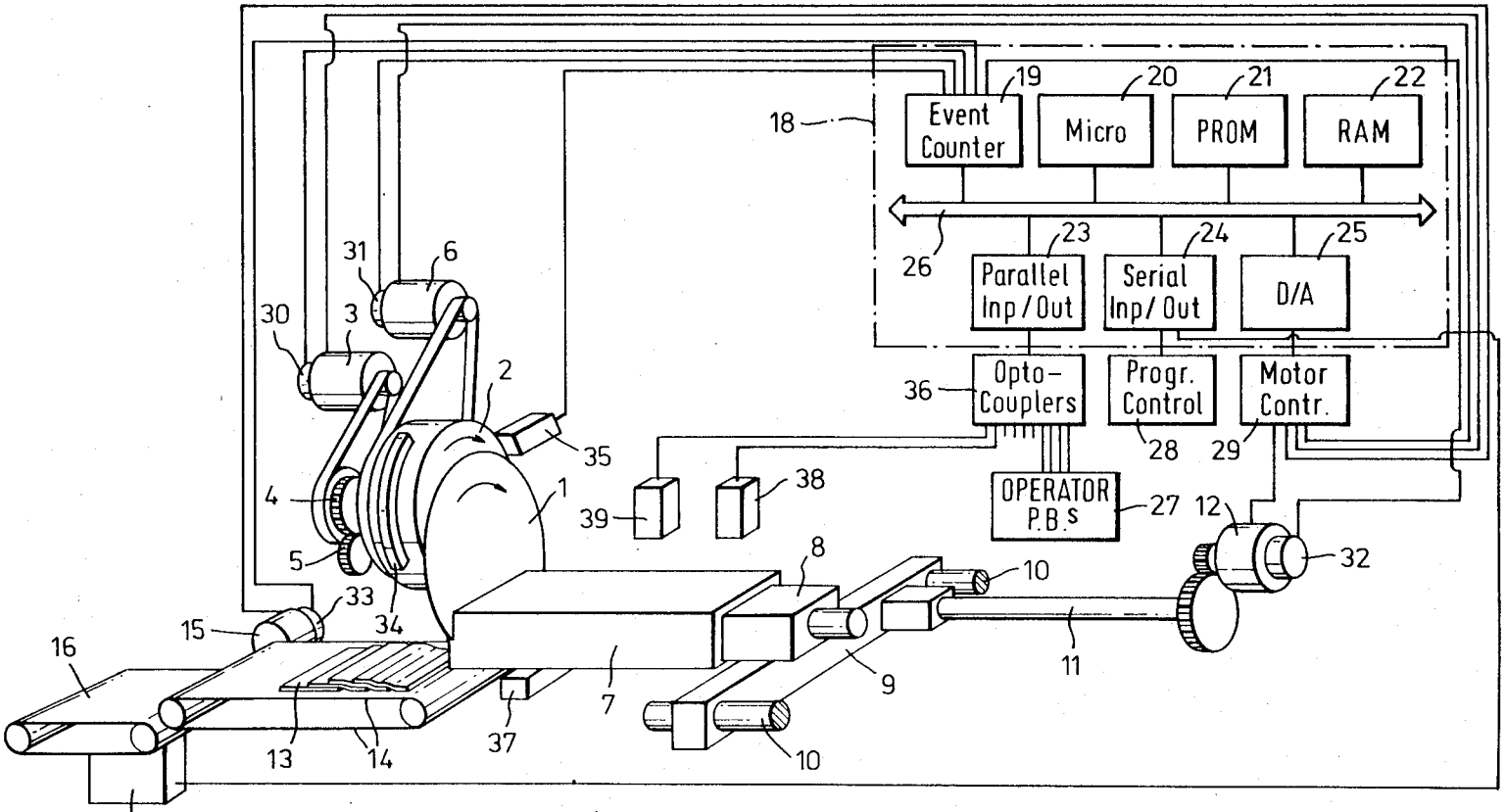
FIG. 1 is a diagrammatic representation of the slicing machine and jump conveyor; and, FIG. 2 is a flow diagram of the program controlling the end of the slicing operation.

The basic mechanical construction of the slicing machine and jump conveyor is conventional and is typically like that known as a "Polyslicer" manufactured by Thurne Engineering Co. Ltd of Norwich, United Kingdom. It comprises a planetary blade 1, journalled in a counter-rotating hub 2. The blade 1 is driven by a motor 3 through pinion gears 4 and 5 and the hub 2 is driven by a motor 6. A block 7 of meat or a meat product is placed on a feed table (not shown) and driven towards the blade 1 by feeding head 8. The feeding head 8 is mounted on a bearer 9 which are carried on a pair of rails 10. The feeding head 8 and bearer 9 are moved backwards and forwards along the rails is by a lead screw 11 which is rotated by a motor 12. Slices 13 of meat or meat product cut from the block 7 fall onto a jump conveyor 14 located downstream of the blade and driven by a motor 15. Downstream from the jump conveyor 14 is a conveyor 16 passing over a weigh cell 17. Slices 13 are cut from the face of the block 7 of meat by the blade 1 at a uniform rate. The jump conveyor 14 moves forward continuously by the motor 15 at a first rate to provide a shingled group of slices as shown in FIG. 1 and then after completion of the number of slices to form that group the jump conveyor 14 is moved at a second, much faster rate by the motor 15, to provide a space between the last slice of one group and the first slice 13 of the next group. The groups of slices 13 are then fed from the jump conveyor 14 onto the conveyor 16 and as they pass over the weigh cell 17 their weight is monitored.

Whilst the mechanical arrangement of the slicer is generally conventional, the slicer also includes a computer 18. The computer 18 may be based on type RT1-1260/1262 manufactured by Prolog Corporation of the U.S.A., for example. The computor 18 typically includes an event counter 19, a microprocessor 20, a programmable read only memory 21, a random access memory 22, parallel input/output ports 23, serial input-/output ports 24, and digital to analogue convertor unit 25 all connected together by a bus 26. The computer 18 is also connected to operator control buttons 27, program control 28 and a motor controller 29. The motor controller 29 controls the operation of the motors 3, 6, 12 and 15 and these include encoders 30, 31, 32 and 33 respectively the outputs of which are fed into the computer.

A cam 34 is mounted on the hub 2 and this cooperates with a proximity switch 35 to identify the angular position of the hub 2. The proximity switch 35 is triggered off both the leading and trailing end of the cam 34 and the computer 18 can naturally also calculate any intermediate angular position by timing between successive actuations of the proximity switch 35. FIG. 1 shows the encoders 30, 31, 32 and 33, and the proximity switch 35 directly linked to the event counter 19 for simplicity, in practice these are coupled through an opto-coupling unit 36 and the ports 23. The computer 18 is thus arranged to control the operation of the motors 3, 6, 12 and 15, and hence control the peripheral speed of the blade 1, the rate of rotation of the hub 2 and hence the rate at which the slices 13 are cut from the block 7, the rate of movement of the block 7 towards the blade 1 and hence the thickness of each slice 13, and also to control the operation of the jump conveyor 14 and hence the number of slices in each group. It also controls the time of operation of the motor 12 in accordance with the output from the proximity switch 35.

The slicing machine also includes a physical abuttment 37 which enagages the bearer 9 and prevents the feeding head 8 coming into contact with the blade 1. The physical abuttment 37 is solely there to stop the feed head 8 engaging the blade 1 when all else has failed and, under normal circumstances the bearer 9 does not touch the abuttment 37. A position detector 38 is located beside the path of movement of the block of meat 7 and detects the presence of the feeding head 8 at a position a predetermined distance upstream from the blade 1. A further position detector 39 acts as an end stop detector and again detects the position of the feeding head 8 but detects the position of the feeding head 8 immediately before the bearer 9 engages the abuttment 37. The outputs from the detectors 38 and 39 are both fed via the opto-coupler unit 36 to the computer 18.

The operation of the slicing machine in accordance with this invention will now be described particularly with reference to FIG. 2 which is a flow diagram of the program operated by the computer 18. Assuming at the moment that the block 7 of meat is being driven continuously towards the obiting blade 1 a slice 13 will cut from the face of the block 7 each time the blade 1 gyrates. An indication of this is given by the proximity switch 35 to the event counter 19 and the computer interrogates the event counter 19 to compare the current count of the number of slices that have been cut held by the event counter 19 with the required number of slices to be formed in each pack. If the number in the event counter 19 has not reached the preset number of slices required for each pack the slicing machine continues to operate. As soon as it is determined that the event counter 19 shows that the same number of slices have been cut as are required in each pack then the computer 18 executes a jump cycle of the jump conveyor 14 by speeding up the motor 15. The computer 18 also determines whether the feed head 8 has passed the detector 38 and if it has not the event counter 19 is reset to zero and the process then is repeated for the next group of slices. This is the process that is performed throughout the majority of the length of the block of meat 7.

Once the position detector 38 has detected the presence of the feed head 8 then another cycle is initiated. In general, this is the cycle shown to the left hand side of FIG. 2. Firstly, a count down is started and this counts down from a preset value which, corresponds to the distance between the detector 38 and the blade 1 and each increment of the encoder 32 attached to the motor 12 driving the feed head 8 decrements the count so that each time a slice is cut from the face of the block of meat 7 the amount that the feed head 8 is moved forward is decremented from the initial count. Each time a slice is cut the computer calculates the remaining length of block 7 to be cut from the current count and compares this with the thickness of the next slice that is to be cut. If the remaining length of the block of meat is greater than the preset slice thickness then one more slice is allowed to be taken and the regular slicing operation of the machine is enabled for one more cycle. Thus, for each slice that is cut after the feed head 8 has been detected by the position detector 38 the computer 18 calculates to check that there is sufficient length of product remaining to enable a slice having the preset thickness to be cut. As soon as insufficient product 7 remains a stop feed head drive signal is produced. This is sent to the right hand side of the flow diagram in FIG. 2 and enters beneath the execute jump cycle instruction. When the stop feed head drive signal has been produced the computer operates the motor 12 in the opposite direction to return the feed head 8 to its starting point and, in due course, stops the operation of the jump conveyor 14.

The end stop detector 39 is connected directly to the stop feed head drive instruction and overrides all other parts of the program so that if, for some reason, anything goes wrong and the feedhead 8 reaches the end stop detector 39 the cutting of that slice is immediately aborted.

An exactly analagous operation is carried out when the block 7 of meat is moved stepwise between each gyration of the blade 1. In this case the computer still checks to make sure that there is sufficient movement remaining of the feed head to provide a slice of the preset thickness before allowing the motor 12 to move the feed head 8 forward by that amount. Thus with a machine in accordance with this invention the feed head 8 does not start to move the block of meat 7 forwards to enable the next slice to be cut unless it has already checked that sufficient movement of the feed head 8 remains to enable a full slice to be cut from the face of the block of meat 7.

Figure 2:
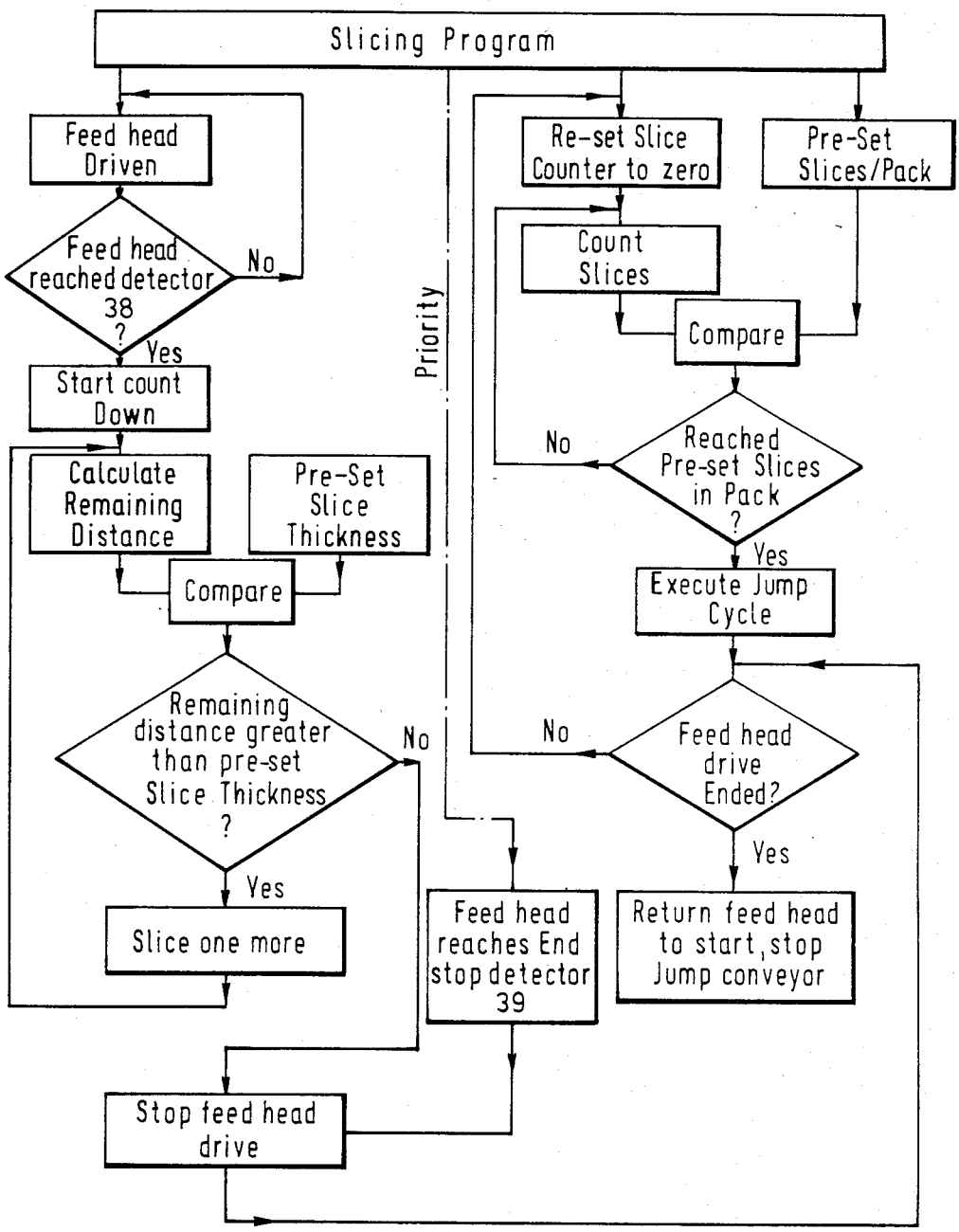

The right hand side of FIG. 2 illustrates that even if the stop feed head drive signal is given after only the first slice has been cut for a particular group, the number of slices in the event counter 19 are still compared with the preset number of slices required for each pack for each orbit of the blade 1 until the required number of slices have apparently been produced by the slicing machine. Only then and only after the jump cycle of the jump conveyor 14 has been executed does the stop feed head drive signal from the left hand side of FIG. 2 have any effect on the operation of the jump conveyor 14. Only when both a jump cycle has been executed and the stop feed head drive signal has been received does the jump conveyor stop. This ensures that the jump conveyor 14 always jumps with the leading slice of each group in the correct position and does not ever jump at any other time.

I claim:

1. A slicing machine including a rotating blade adapted to cut slices from a product to be sliced, a feed head engaging said product, feeding means driving said feed head whereby said feed head urges said product towards said blade, a position detector to detect when said feed head is a predetermined distance from said blade, an encoder associated with said feeding means to monitor movement of said feed head over said predetermined distance, monitoring means to monitor cutting movement of said blade, and determining means responsive to said encoder and said monitoring means to determine when there is insufficient movement of said feed head remaining to allow another whole slice of product to be cut before said feed head reaches the end of its stroke, and to return said feed head to its starting position after completion of slicing of the last whole slice of said product.

2. The slicing machine of claim 1, which also includes a physical abutment to prevent further movement of said feed head by said feeding means to thereby prevent said feed head contacting said blade, and an end stop detector, said end stop detector being located immediately before said physical abutment, said determining means also being responsive to said end stop detector to stop movement of said feeding means and return said feed head to its starting position, said end stop detector acting as a failsafe device to prevent damage to said slicing machine.

3. The slicing machine of claim 1, also including a jump conveyor, said jump conveyor being located downstream from said blade to receive slices cut by said blade and marshalling them into groups, and wherein said determining means also controls operation of said jump conveyor whereby said jump conveyor continues to move in response to said monitoring eans as if slices are still being cut from said producteven after said feed head has returned to its starting position until said determining means initiates the jump conveyor to perform a jump to marshall said slices into said groups.

4. The slicing machine of claim 1, wherein said determining means is formed by a computer programmed to determine when there is insufficient movement of said feed head remaining to allow another whole slice of product to be cut by using the output of said encoder to decrement a count established in the computer to represent said predetermined distance and then comparing the movement required for the next slice with said decremented count.

5. The slicing machine of claim 4, wherein said computer monitors movement of said feed head during its movement over said predetermined distance and from this establishes an average movement of said feed head for each slice, and then compares said average movement with said decremented count.

6. The slicing machine of claim 4, wherein said computer also controls thickness of said slices and compares the required thickness of the next slice with the decremented count.

7. The slicing machine of claim 3, wherein said determining means is formed by a computer programmed to determine when there is insufficient movement of said feed head remaining to allow another whole slice of product to be cut by using the output of said encoder to decrement a count established in the computer to represent said predetermined distance and then comparing the movement required for the next slice with said decremented count.

8. The slicing machine of claim 7, wherein said computer monitors movement of said feed head during its movement over said predetermined distance and from this establishes an average movement of said feed head for each slice, and then compares said average movement with said decremented count.

9. The slicing machine of claim 8, wherein said computer also controls thickness of said slices and compares the required thickness of the next slice with the decremented count.

* * * * *